US009061298B2

(12) United States Patent
Eley et al.

(10) Patent No.: US 9,061,298 B2
(45) Date of Patent: Jun. 23, 2015

(54) ADJUSTABLE SPRAYER

(71) Applicant: Eley Corporation, Lincoln, NE (US)

(72) Inventors: Craig D. Eley, Lincoln, NE (US); Darin L. Schollmeyer, Creighton, NE (US)

(73) Assignee: ELEY CORPORATION, Lincoln, NE (US)

( * ) Notice: Subject to any disclaimer, the term of this patent is extended or adjusted under 35 U.S.C. 154(b) by 0 days.

(21) Appl. No.: 14/296,701

(22) Filed: Jun. 5, 2014

(65) Prior Publication Data

US 2014/0284403 A1 Sep. 25, 2014

Related U.S. Application Data

(63) Continuation-in-part of application No. 13/339,054, filed on Dec. 28, 2011, now Pat. No. 8,794,546.

(51) Int. Cl.

| | |
|---|---|
| ***B05B 1/32*** | (2006.01) |
| ***B05B 1/16*** | (2006.01) |
| ***B05B 1/14*** | (2006.01) |
| ***B05B 1/12*** | (2006.01) |
| ***B05B 1/18*** | (2006.01) |

(52) U.S. Cl.

CPC ..... *B05B 1/1609* (2013.01); *B05B 1/12* (2013.01); *B05B 1/1663* (2013.01); *B05B 1/18* (2013.01)

(58) Field of Classification Search

CPC ..... B05B 1/12; B05B 1/16; B05B 1/1609; B05B 1/1654; B05B 1/1663; B05B 1/1681; B05B 1/18; B05B 1/3026; B05B 1/3066; B05B 1/308; A62B 31/02; A62B 31/03

USPC ..... 239/390–392, 394, 436–441, 451, 456, 239/457, 460, 525, 541

See application file for complete search history.

(56) References Cited

U.S. PATENT DOCUMENTS

| | | | | | |
|---|---|---|---|---|---|
| 2,313,994 | A | * | 3/1943 | Grant | 239/440 |
| 2,323,464 | A | * | 7/1943 | Glessner | 239/441 |
| 2,944,743 | A | * | 7/1960 | Kachergis | 239/458 |
| 3,219,278 | A | * | 11/1965 | Santarelli | 239/579 |
| 3,502,270 | A | * | 3/1970 | Prencipe | 239/458 |
| 3,514,042 | A | * | 5/1970 | Freed | 239/458 |
| 3,784,112 | A | * | 1/1974 | Collignon | 239/443 |

* cited by examiner

*Primary Examiner* — Darren W Gorman
(74) *Attorney, Agent, or Firm* — Perkins Coie LLP

(57) ABSTRACT

An adjustable sprayer comprising a fitting that includes a connector portion, an elongate cylindrical portion extending from the connector portion, and a bore formed longitudinally through the fitting. The sprayer includes a nozzle having a sleeve portion configured to receive the fitting's cylindrical portion whereby the nozzle is moveable, longitudinally, along the cylindrical portion between first and second spray positions. Movement of the nozzle into the first position permits a full diameter spray pattern through a water breaker. In the second position, fluid flow is restricted to a reduced diameter spray pattern through the water breaker.

17 Claims, 13 Drawing Sheets

ADJUSTABLE SPRAYER

CROSS-REFERENCE TO RELATED APPLICATIONS

The present application is a continuation-in-part of U.S. patent application Ser. No. 13/339,054, filed Dec. 28, 2011, titled "ADJUSTABLE SPRAYER", now U.S. Pat. No. 8,794,546, which is incorporated herein as if set out in full.

BACKGROUND

Watering nozzles, known as water breakers, are a favorite for gardening enthusiasts and professionals for quickly watering potted or bedded plants. Water breakers deliver a large amount of water in a soft shower pattern. The typical water breaker is adequate if the user is close enough to reach the plants. However, to water plants with the same soft shower pattern from a further distance, the user must get closer to the plant or change nozzles. In either case, it is inconvenient and an inefficient way to water a large area. Furthermore, nozzles designed to reach a further distance will disrupt the soil, especially if used up close, thereby defeating the purpose of a water breaker type sprayer.

Accordingly, there is a need for an adjustable sprayer capable of delivering the same soft volume of water that a normal water breaker delivers yet can adjust to deliver that spray further to reach plants that would normally require repositioning or changing the nozzle to a different style.

SUMMARY

Provided herein is an adjustable sprayer capable of delivering the same soft volume of water that a normal water breaker delivers yet can adjust to deliver that spray further to reach plants that would normally require repositioning or changing the nozzle to a different style. According to an embodiment, the adjustable sprayer includes a fitting having a connector portion, an elongate cylindrical portion extending from the connector portion, and a bore formed longitudinally through the fitting. The connector portion includes threads mateable with a garden hose. The sprayer includes a nozzle connected to the fitting.

The nozzle includes a sleeve portion configured to receive the fitting's cylindrical portion whereby a sleeve portion of the nozzle is moveable, longitudinally, along the cylindrical portion between first and second spray positions. In an embodiment, the nozzle is rotatably disposed on the cylindrical portion. The sprayer includes an o-ring seal disposed inside the sleeve portion, which is operative to provide a seal between the cylindrical portion and the sleeve portion. The nozzle includes a primary outlet and at least one secondary outlet radially spaced from the primary outlet. The cylindrical portion is in fluid communication with only the primary outlet when the nozzle is in the first spray position, and the cylindrical portion is in fluid communication with both the primary and secondary outlets when the nozzle is in the second spray position.

The cylindrical portion of the fitting is adapted to seal with the cylindrical ring when the nozzle is in the first spray position. An o-ring seal may be disposed inside the cylindrical ring. Alternatively, the cylindrical portion and the cylindrical ring include mating frustoconical sealing surfaces.

In an embodiment, the primary outlet and the at least one secondary outlet is concentric with each other. The nozzle includes a surrounding sidewall extending from the sleeve portion defining an interior region. The surrounding sidewall may diverge from the sleeve portion. The primary outlet comprises a cylindrical ring supported in the interior region. In an embodiment, the cylindrical ring is supported in the interior region by a plurality of radially extending stanchions. The secondary outlet comprises the area between the surrounding sidewall and the cylindrical ring. The sprayer also includes a perforated screen disposed adjacent to the primary and secondary outlets.

Embodiments of the adjustable sprayer may also include a retaining ring disposed in the sleeve portion, and wherein the cylindrical portion includes a plurality of longitudinally spaced detent grooves adapted to receive the retaining ring. The detent grooves are adapted to receive the retaining ring and correspond to the first and second spray positions respectively.

In other embodiments, the adjustable sprayer includes an outlet insert, having a cylindrical ring and an output end portion that extends outwardly from the cylindrical ring. In some embodiments, a flange is disposed to extend inwardly from an end of the output end portion to define the shape of the outlet. The outlet insert is coupled with the end portion of the fitting so that it is disposed in the interior of the nozzle. In a first spray position, the cylindrical portion is fully retracted with respect to the nozzle so that the outlet insert contacts a rearward portion of the nozzle interior. In this position, fluid flows from the outlet of the outlet insert and floods the interior of the nozzle before exiting through a "full diameter" of the perforated screen. In the second spray position, the flange of the outlet insert is positioned against the perforated screen to define a "reduced diameter" of the perforated screen through which fluid is allowed to flow. The restrictive nature of the "reduced diameter" produces a more narrow fluid spray pattern that reaches a further distance than that afforded by the "full diameter" without altering the spray pattern.

These and other aspects of the adjustable sprayer will be apparent after consideration of the Detailed Description and Figures herein.

DRAWINGS

Non-limiting and non-exhaustive embodiments of the adjustable sprayer, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
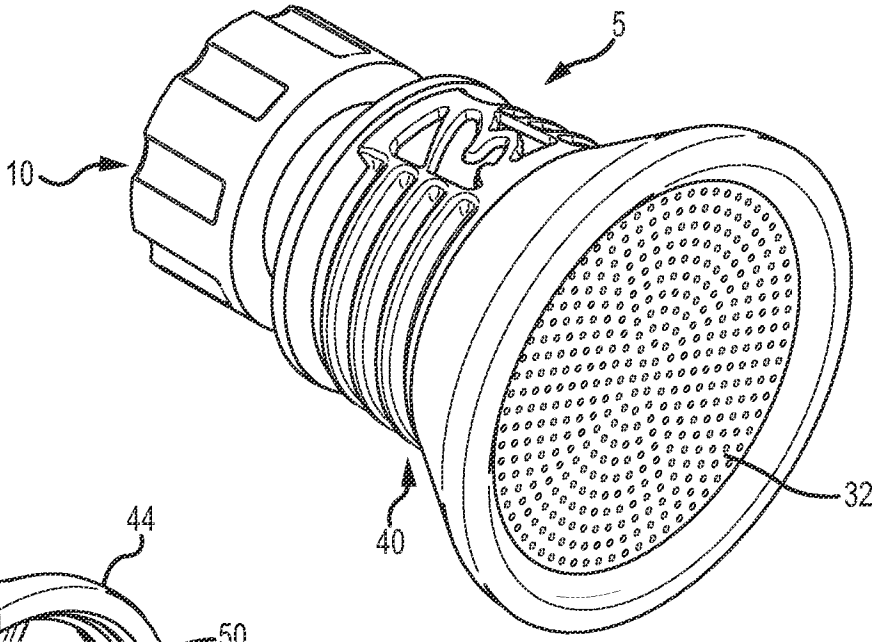
FIG. 1 is a perspective view of an adjustable sprayer according to a first exemplary embodiment.
Figure 2:
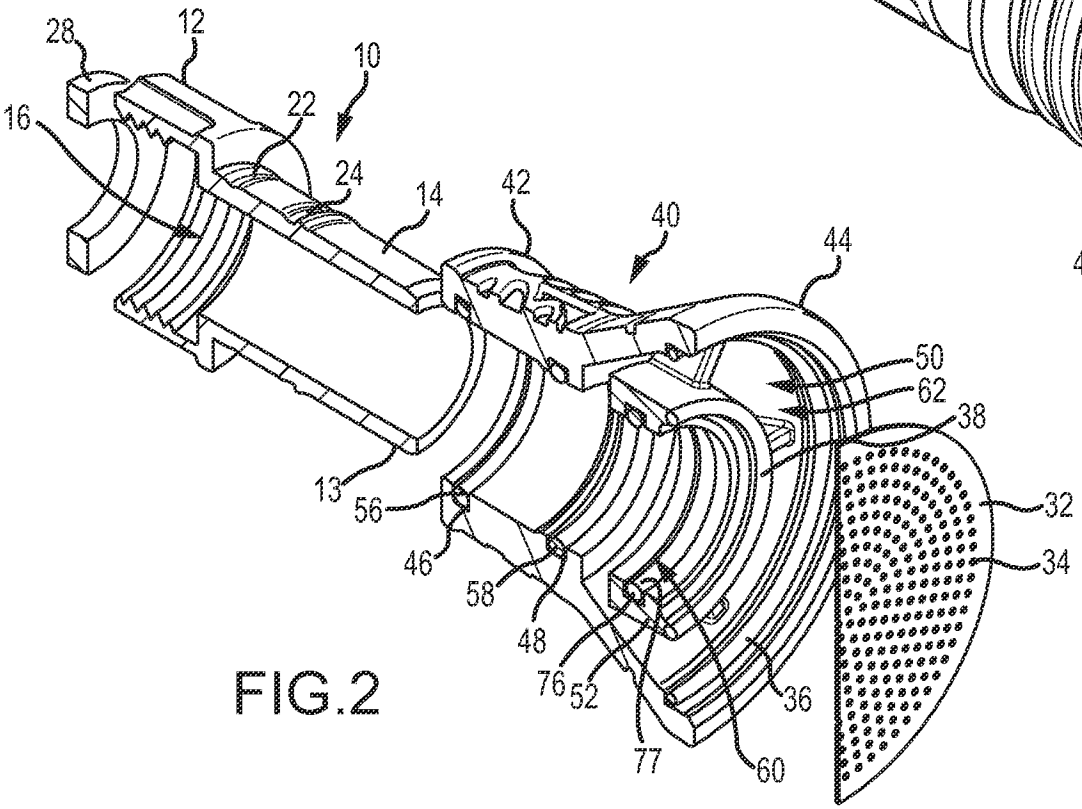
FIG. 2 is an exploded cross-sectional view of the adjustable sprayer shown in FIG. 1.

The adjustable sprayer 5, shown in FIG. 1, includes a fitting 10 with a nozzle 40 attached thereto. Nozzle 40 also includes a perforated screen 32, which is sometimes referred to as a water breaker. With further reference to FIG. 2, the fitting 10 includes a connector portion 12 with an elongate cylindrical portion 14 extending therefrom. A bore 16 is formed longitudinally through the fitting. Connector portion 12 may receive a washer 28. For instance, washer 28 may be comprised of rubber to provide a seal between a garden hose and the connector portion. Mating threads 18 enable threaded engagement with threaded connectors on garden hoses and the like.

Figure 6:
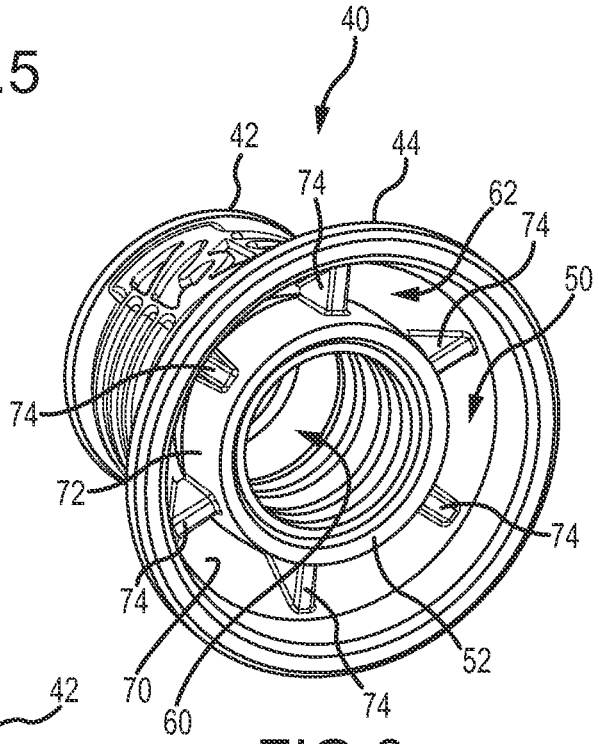
FIG. 6 is a perspective view of the nozzle as viewed from the front.

With reference to FIGS. 2 and 6, nozzle 40 includes a sleeve portion 42 that is configured to receive the cylindrical portion 14 whereby the nozzle 40 is movable longitudinally along the cylindrical portion between first and second spray positions. Nozzle 40 also includes a surrounding sidewall 44 and a cylindrical ring 52 supported in the interior 50 of the surrounding sidewall 44. Surrounding sidewall 44 extends from sleeve portion 42. In this case, surrounding sidewall 44 diverges away from the sleeve portion. In this embodiment, cylindrical ring 52 is supported in the interior 50 of surrounding sidewall 44 by a plurality of radially extending stanchions 74. Thus, nozzle 40 includes a primary outlet 60 and at least one secondary outlet 62 radially spaced from the primary outlet. Primary outlet 60 is defined by the interior of ring 52, whereas the secondary outlet is defined by the inner surface 70 of surrounding sidewall 44 and the outer surface 72 of cylindrical ring 52 (see FIG. 6).

Figure 3:
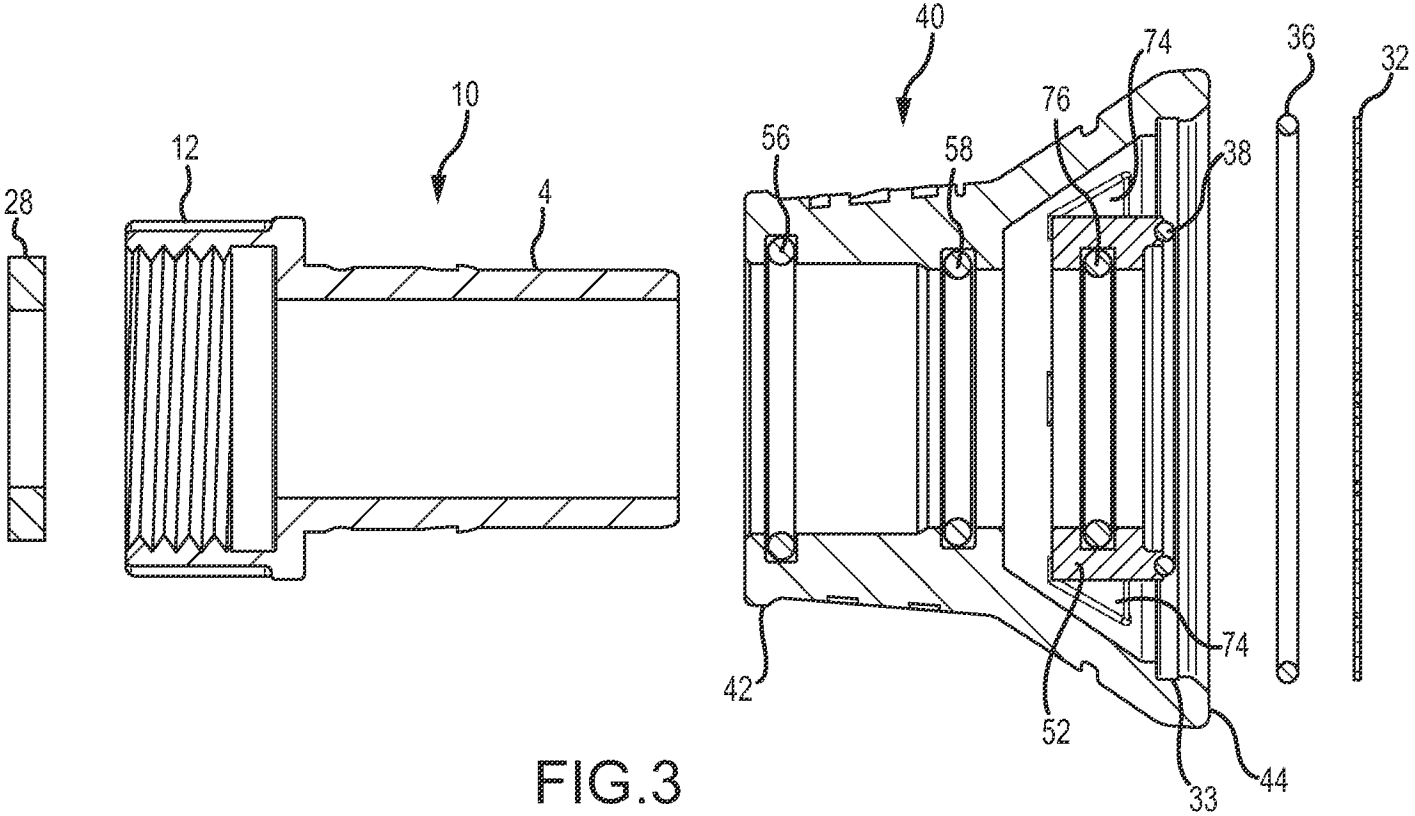
FIG. 3 is an exploded side view of the adjustable sprayer shown in FIG. 1.

Perforated screen 32 includes a plurality of holes 34 through which water is sprayed. With reference to FIG. 3, the perforated screen 32 snaps into groove 33 of nozzle 40. Groove 33 also accommodates an O-ring 36 against which the perforated screen 32 seals. Perforated screen 32 also seals against O-ring 38 which is supported by cylindrical ring 52.

With reference to FIGS. 2 and 3, sleeve portion 42 includes a retaining ring groove 46 in which resides a retaining ring 56. In this case, retaining ring 56 may be a snap ring of metal construction. Sleeve portion 42 also includes an O-ring groove or seal groove 48 within which is disposed an O-ring 58. Accordingly, the elongate cylindrical portion 14 of fitting 10 is sealed against the O-ring 58 when inserted into the sleeve portion 42. Retaining ring 56 is operative to engage detent grooves 22, 24 formed around the outside of the elongate cylindrical portion. It should be understood that the nozzle 40 may rotate about the cylindrical portion 14.

Figure 4A:
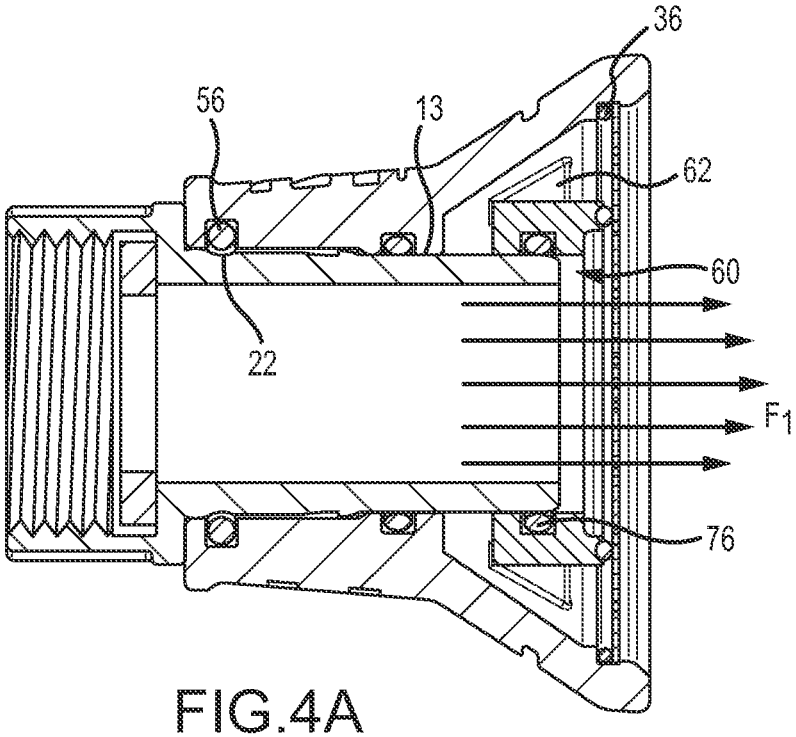
FIG. 4A is a cross-sectional side view of the adjustable sprayer shown in FIG. 1 in a first spray position.
Figure 4B:
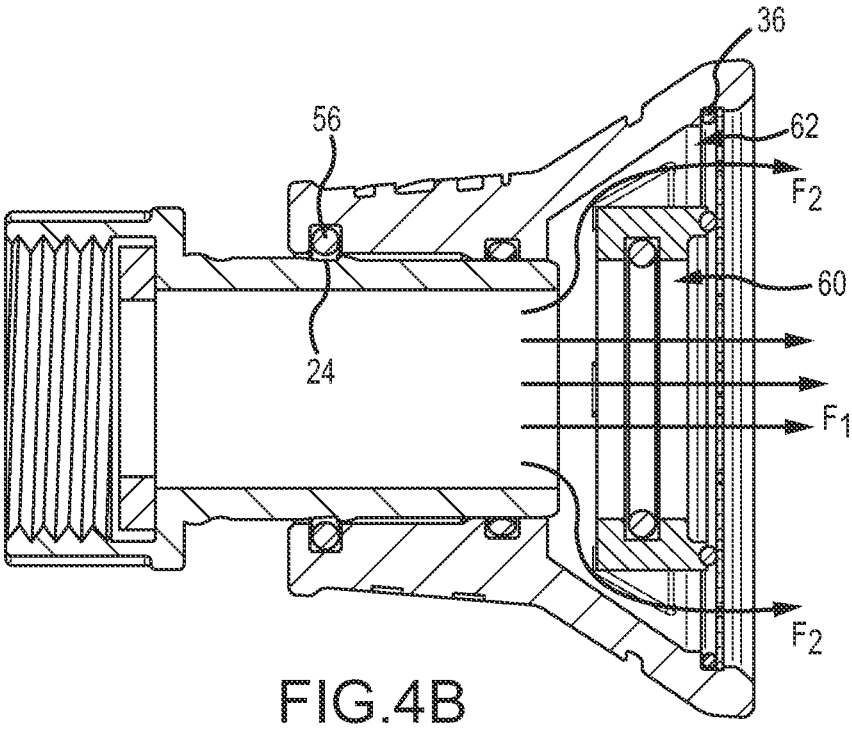
FIG. 4B is a cross-sectional side view of the adjustable sprayer shown in FIG. 1 in a second spray position.

Referring to FIGS. 4A and 4B, the first and second spray positions may be more fully understood. In FIG. 4A, the adjustable sprayer is shown in a first spray position in which the cylindrical portion 14 is in fluid communication with only the primary outlet 60. When the nozzle is in the first spray position, O-ring 77, seated within groove 76 of the ring 52, seals against an end portion 13 of fitting 10. Accordingly, fluid flowing from the adjustable sprayer is directed through only the primary outlet 60 as indicated by arrows F1. As shown in FIG. 4B, when the nozzle is in the second spray position, fluid is allowed to flow through both the primary outlet 60 and the secondary outlets 62. Fluid flowing from the primary outlet 60 is indicated by arrows F1, and fluid flowing through the secondary outlets is indicated by arrows F2. It can also be appreciated in FIGS. 4A and 4B that the nozzle is retained in the first and second spray positions when retaining ring 56 engages a respective detent groove 22 or 24.

Figure 5:
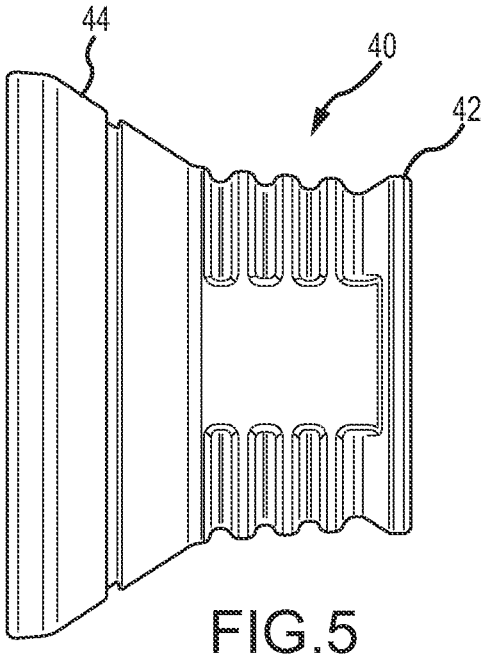
FIG. 5 is a side view in elevation of the nozzle.
Figure 7:
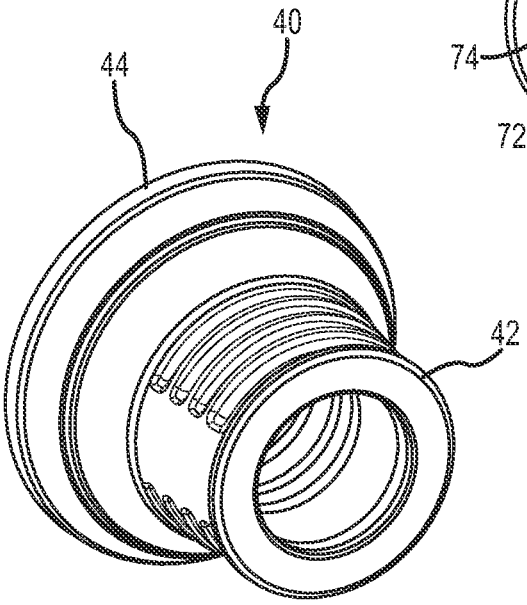
FIG. 7 is a perspective view of the nozzle as viewed from the back.

The nozzle 40, as shown in FIGS. 5-7, includes a sleeve portion 42 from which extends a diverging surrounding sidewall 44. The surrounding sidewall 44 defines an interior region 50 in which is supported a cylindrical ring 52. Cylindrical ring 52 defines the primary outlet 60 while the secondary outlet (or outlets) 62 is defined as the region between the inner surface 70 of surrounding sidewall 44 and outer surface 72 of cylindrical ring 52. In this embodiment, cylindrical ring 52 is supported in the interior region 50 by a plurality of stanchions 74.

Figure 8:
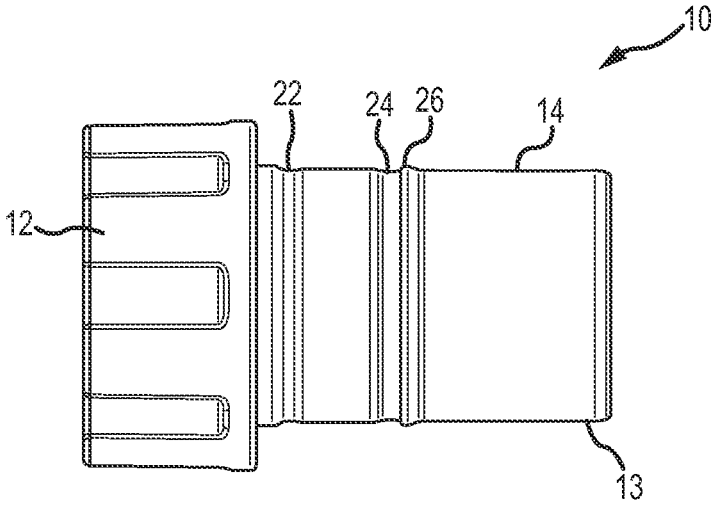
FIG. 8 is a side view in elevation of the fitting.
Figure 9:
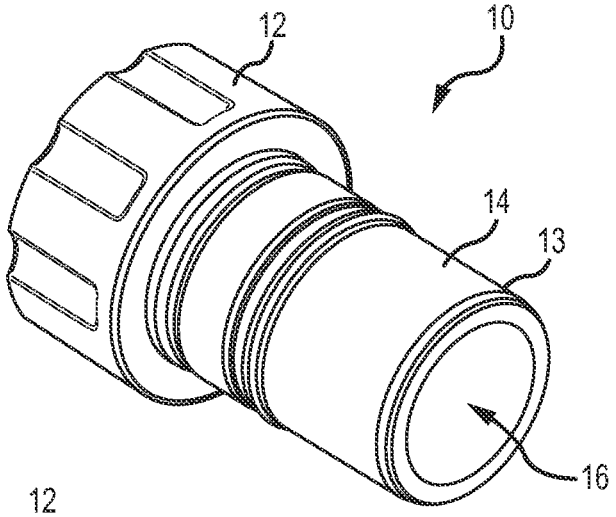
FIG. 9 is a perspective view as viewed from the front of the fitting shown in FIG. 8.
Figure 10:
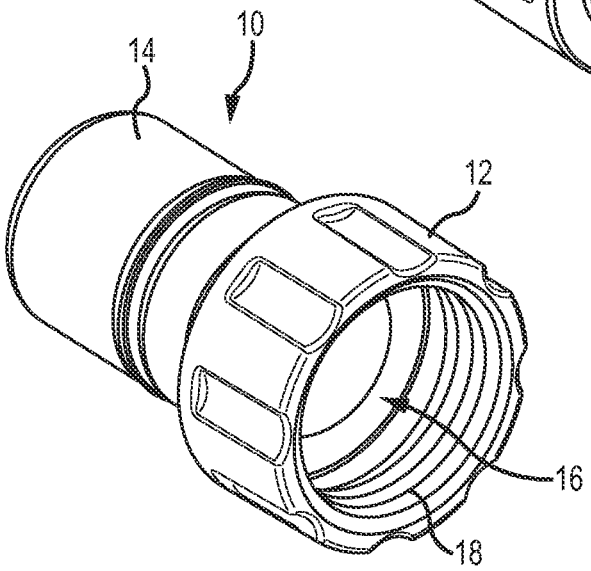
FIG. 10 is a perspective view of the fitting as viewed from the back.
Figure 11:
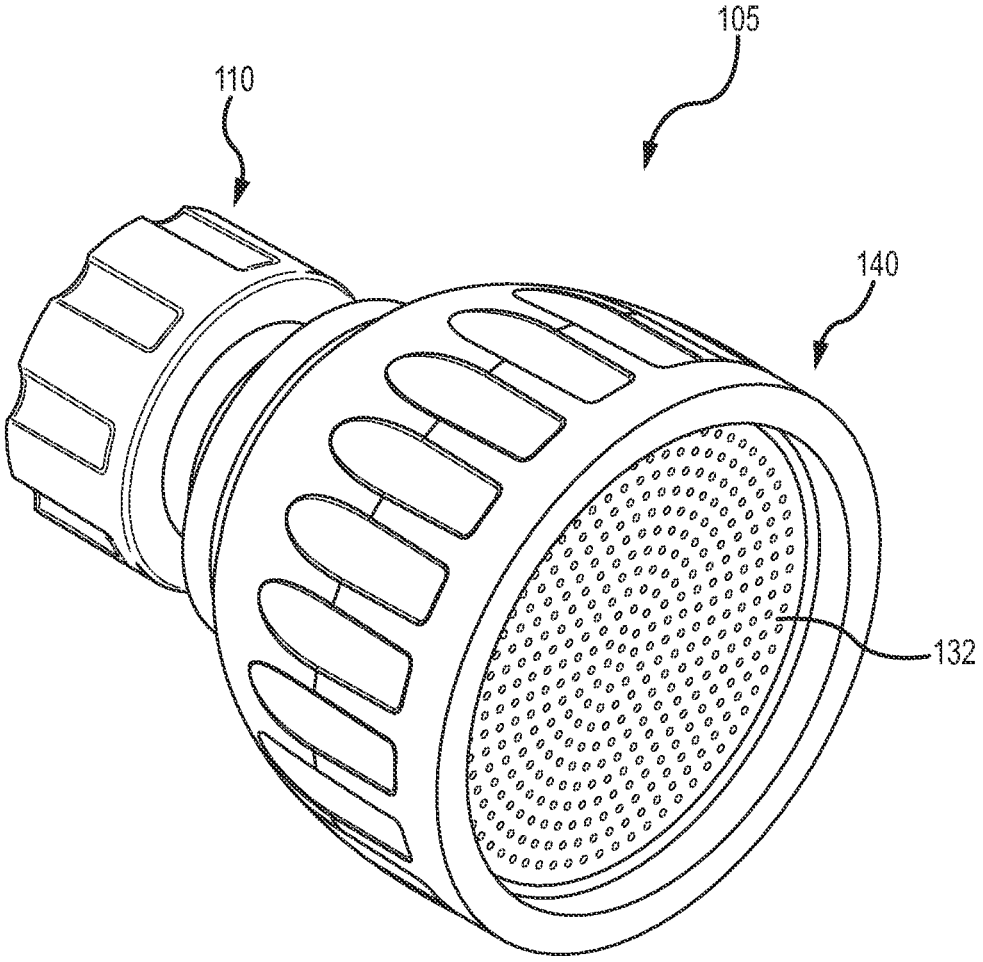
FIG. 11 is an adjustable sprayer according to a second exemplary embodiment.

The fitting 10, as shown in FIGS. 8-10, includes connector portion 12 and an elongate cylindrical portion 14, extending from the connector portion 12. Elongate cylinder 14 has an end portion 13 and a bore 16 formed through the fitting. Cylindrical portion 14 also includes a plurality of detent grooves. In this case, the cylindrical portion 14 includes two detent grooves 22, 24 which correspond respectively to first and second spray positions. Cylindrical portion 14 also includes a barb 26 adjacent detent groove 24. Barb 26 inhibits removal of nozzle 40 from fitting 10. As shown in FIG. 10, the connector portion 12 includes threads 18 configured for attachment to a garden hose, for instance.

Figure 12:
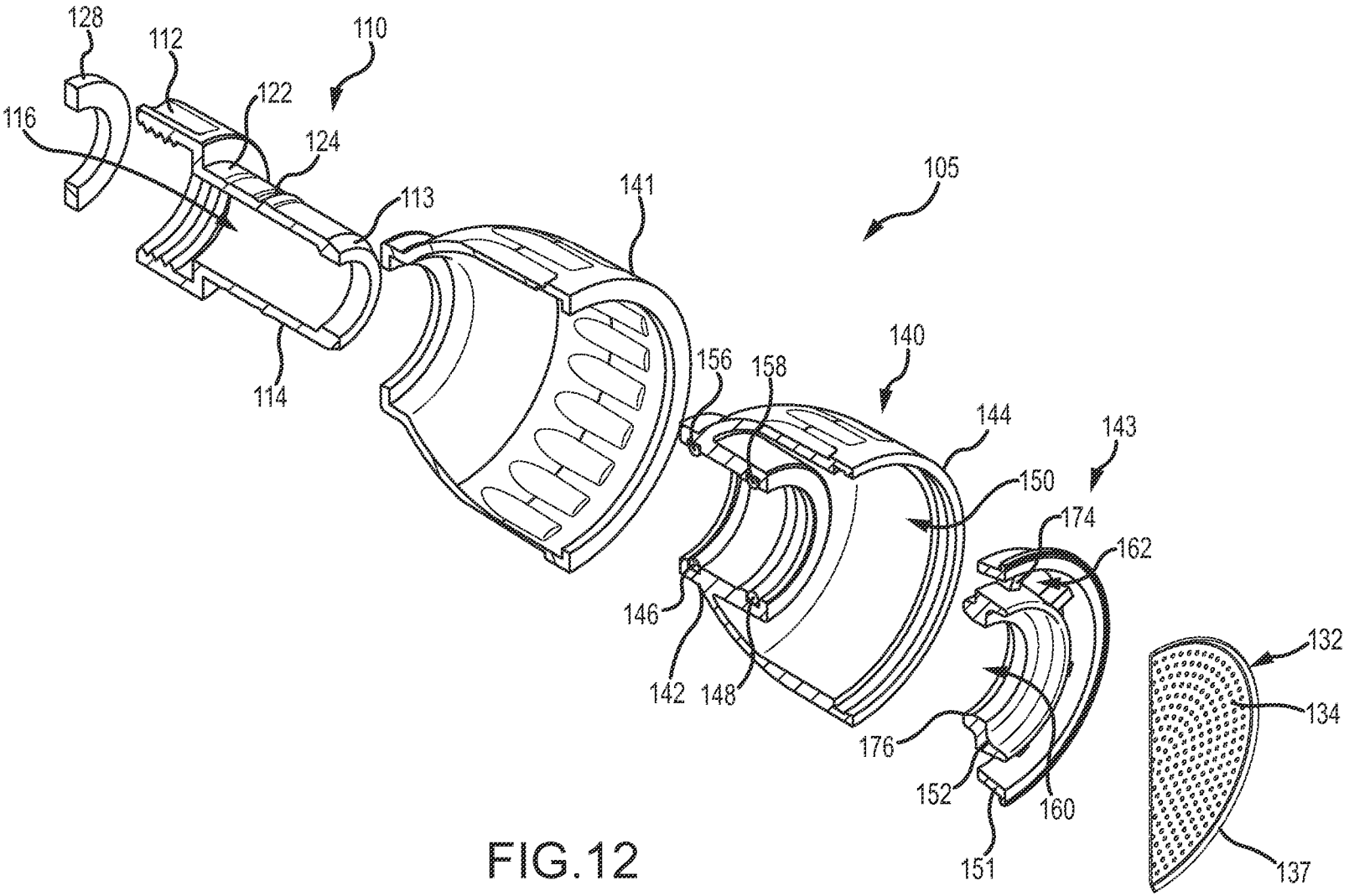
FIG. 12 is an exploded cross-section in perspective of the adjustable sprayer shown in FIG. 11.

An adjustable sprayer 105 according to a second exemplary embodiment is shown in FIGS. 11-14. Adjustable sprayer 105 also includes a fitting 110 and a nozzle 140 disposed on the fitting. Nozzle 140 also includes a water breaker in the form of a perforated screen 132. Perforated screen 132 includes a plurality of holes 134 through which water is sprayed. With reference to FIG. 12, it can be appreciated that adjustable sprayer 105 is similar to the embodiment described above with respect to FIGS. 1-10. However, in this case, the nozzle 140 also includes a cover 141 and an outlet insert 143. As above, the nozzle 140 includes a sleeve portion 142 from which extends the surrounding sidewall 144 defining an interior 150. Sleeve portion 142 includes a retaining ring groove 146 in which resides a retaining ring 156. Retaining ring 156 may be a snap ring of metal construction. Sleeve portion 142 also includes an O-ring groove or seal groove 148 within which an O-ring 158 is disposed. Accordingly, the elongate cylindrical portion 114 of fitting 10 is sealed against the O-ring 158 when inserted into the sleeve portion 142. Retaining ring 156 operates to engage detent grooves 122, 124 formed around the outside of the elongate cylindrical portion. It should be understood that the nozzle 140 may rotate about the cylindrical portion 114.

The outlet insert 143 is disposed in the interior 150 of the nozzle 140. Outlet insert 143 includes an outer ring 151 and an inner ring 152. The inner ring 152 is supported within the outer ring 151 by a plurality of stanchions 174. In this case, the primary outlet 160 is defined by the interior of inner ring 152. Secondary outlets 162 are defined by the region between the inner ring 152 and the outer ring 151.

With reference to FIG. 12, fitting 110 of adjustable sprayer 105 is similar to that as described above, in that it includes a connector portion 112 from which extends a cylindrical portion 114. Cylindrical portion 114 includes a plurality of detent grooves. In the depicted embodiment, the cylindrical portion 114 includes two detent grooves 122, 124 which correspond respectively to first and second spray positions. Cylindrical portion 114 also includes a barb adjacent detent groove 24, which inhibits removal of nozzle 140 from fitting 110. As depicted, various embodiments of the connector portion 112 include mating threads 18 configured for attachment to reciprocally threaded fittings, such as those on garden hoses. A bore 116 is formed longitudinally through the fitting 110. In this case, however, fitting 110 includes a frustoconical end portion 113 which is adapted to mate with a mating frustoconical surface 176 formed in inner ring 152.

Figure 13A:
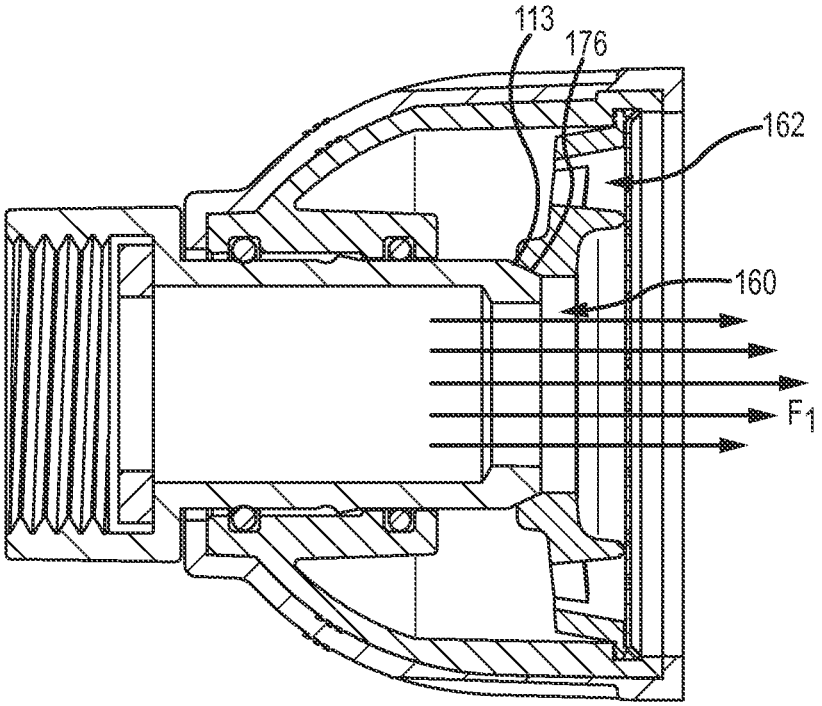
FIG. 13A is a side view in cross-section of the adjustable sprayer shown in FIG. 11 in a first spray position.
Figure 13B:
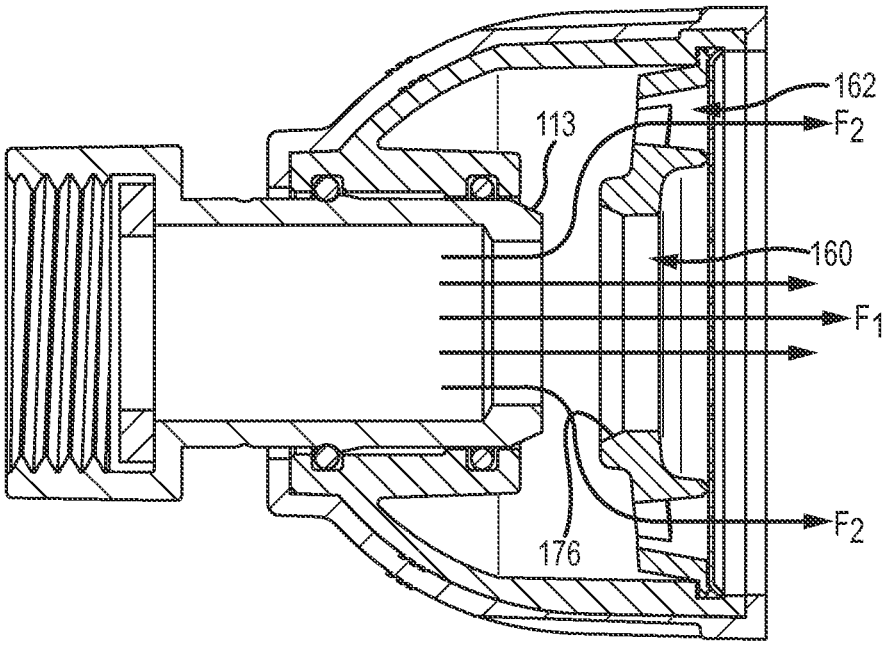
FIG. 13B is a cross-sectional side view of the adjustable sprayer shown in FIG. 11 in a second spray position.

With further reference to FIG. 13A, it can be appreciated that when the nozzle is in the first spray position, frustoconical mating surfaces 113 and 176 provide a seal between the end portion 113 and inner ring 152. Accordingly, when in the first spray position, fluid flows only through the primary outlet 160. With reference to FIG. 13B, when the nozzle is in the second spray position, fluid is allowed to flow through both primary outlet 160 indicated by arrows F1 as well as through secondary outlets 162 indicated by arrows F2.

Figure 14:
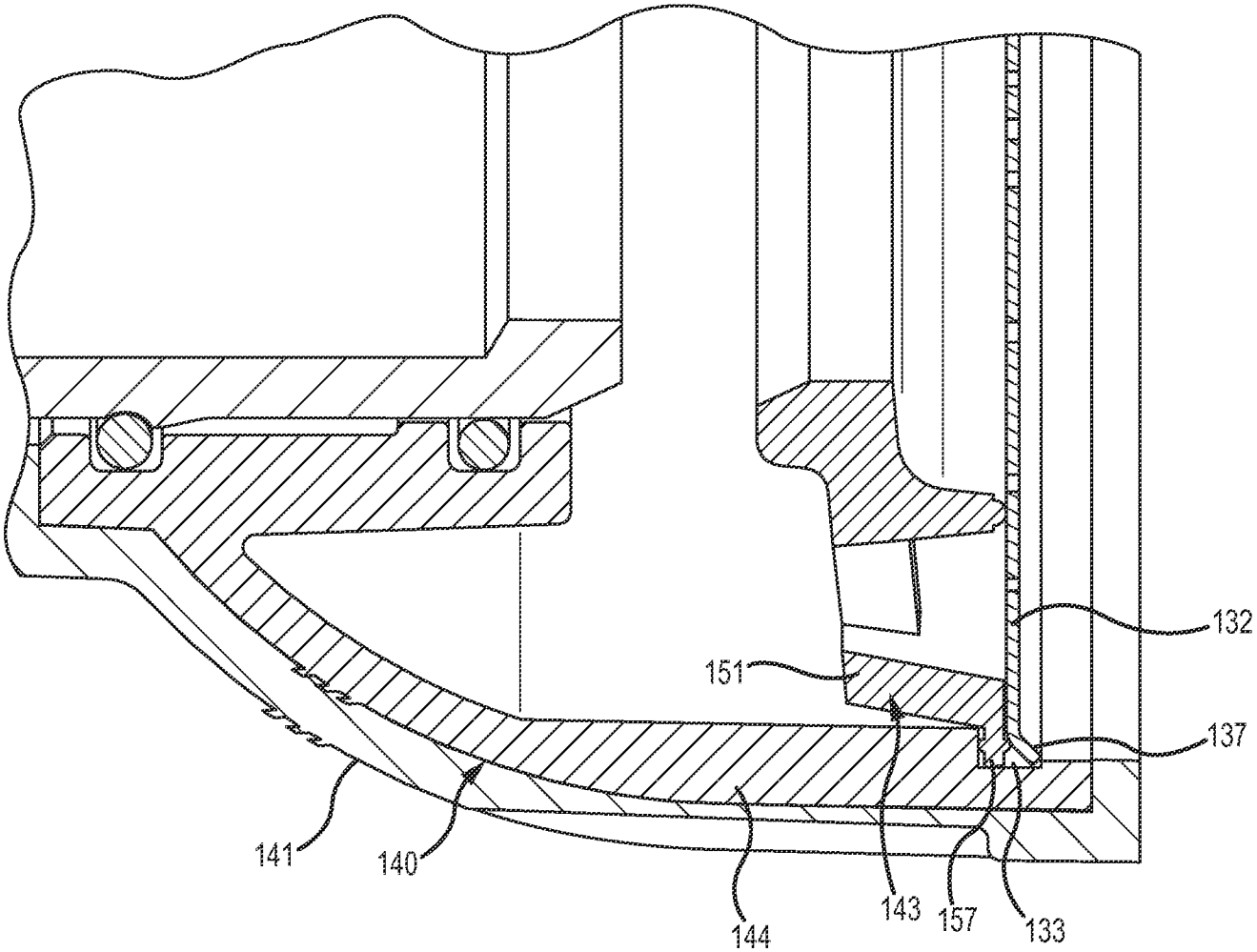
FIG. 14 is a partial cross-section illustrating the assembly of the perforated screen and nozzle insert.

FIG. 14 illustrates the installation of outlet insert 143 into surrounding sidewall 144. Outer ring 151 of the outlet insert 143 includes a flange 157 which is disposed in groove 133 formed around the interior of surrounding sidewall 144. The outlet insert 143 is retained in groove 133 by perforated screen 132. Perforated screen 132 includes a surrounding flange 137 which may be pressed into the groove 133 against flange 157 to engage an edge of groove 133, thereby retaining both the perforated screen 132 and the outlet insert 143 in the nozzle 140.

With reference to FIGS. 15-18B, an adjustable sprayer 205 includes a fitting 210 and nozzle 240. Nozzle 240 includes a perforated screen 232, having a plurality of holes 234, through which water or other fluids exit the adjustable sprayer 205. The fitting 210 includes a connector portion 212 with an elongate cylindrical portion 214 extending therefrom to an opposing end portion 213. A bore 216 extends longitudinally through the fitting 210. In various embodiments, connector portion 212 includes a washer 228 to provide a seal between a garden hose and the connector portion 212. Mating threads 218 enable threaded engagement with threaded connectors on garden hoses and the like.

Figure 15:
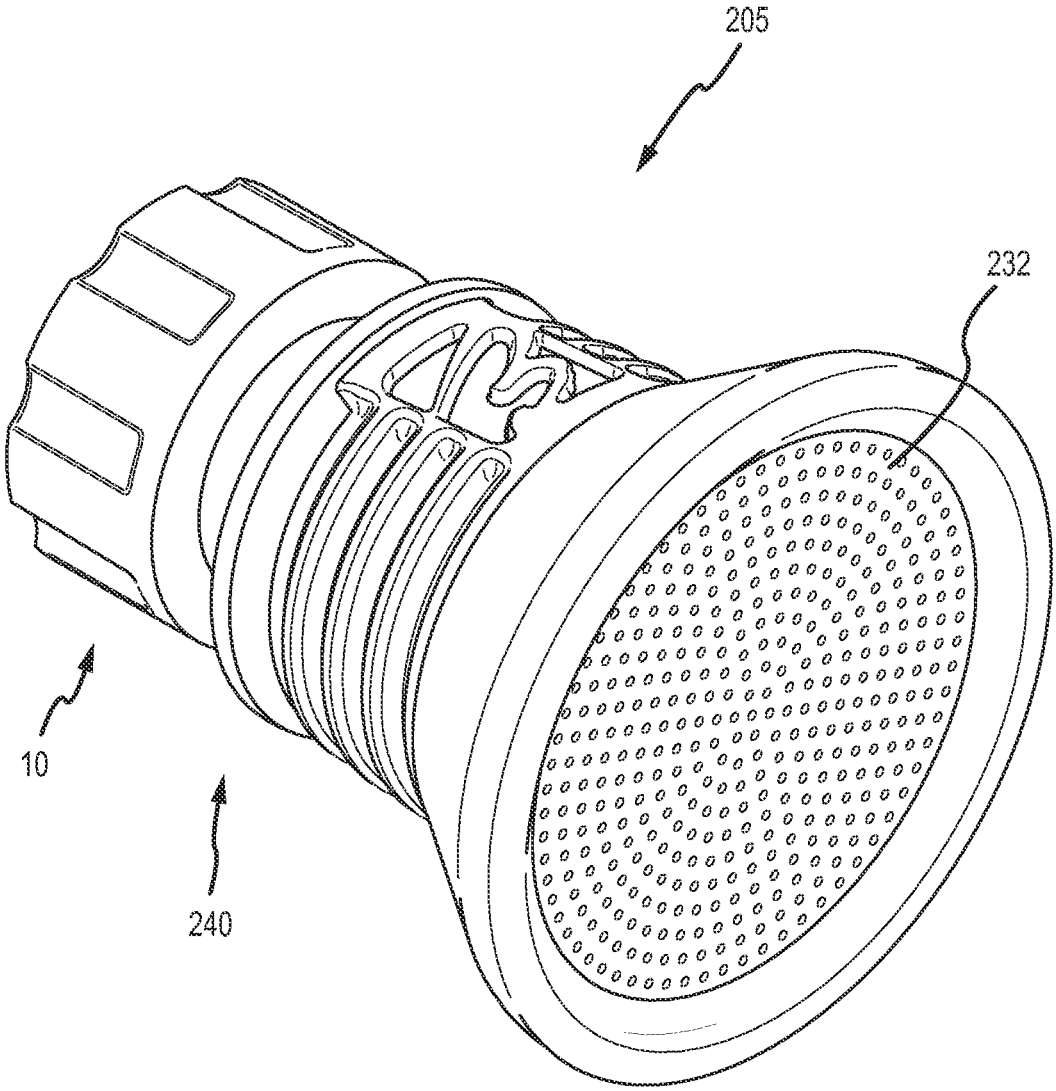
FIG. 15 is a perspective view of an adjustable sprayer according to a third exemplary embodiment.
Figure 16:
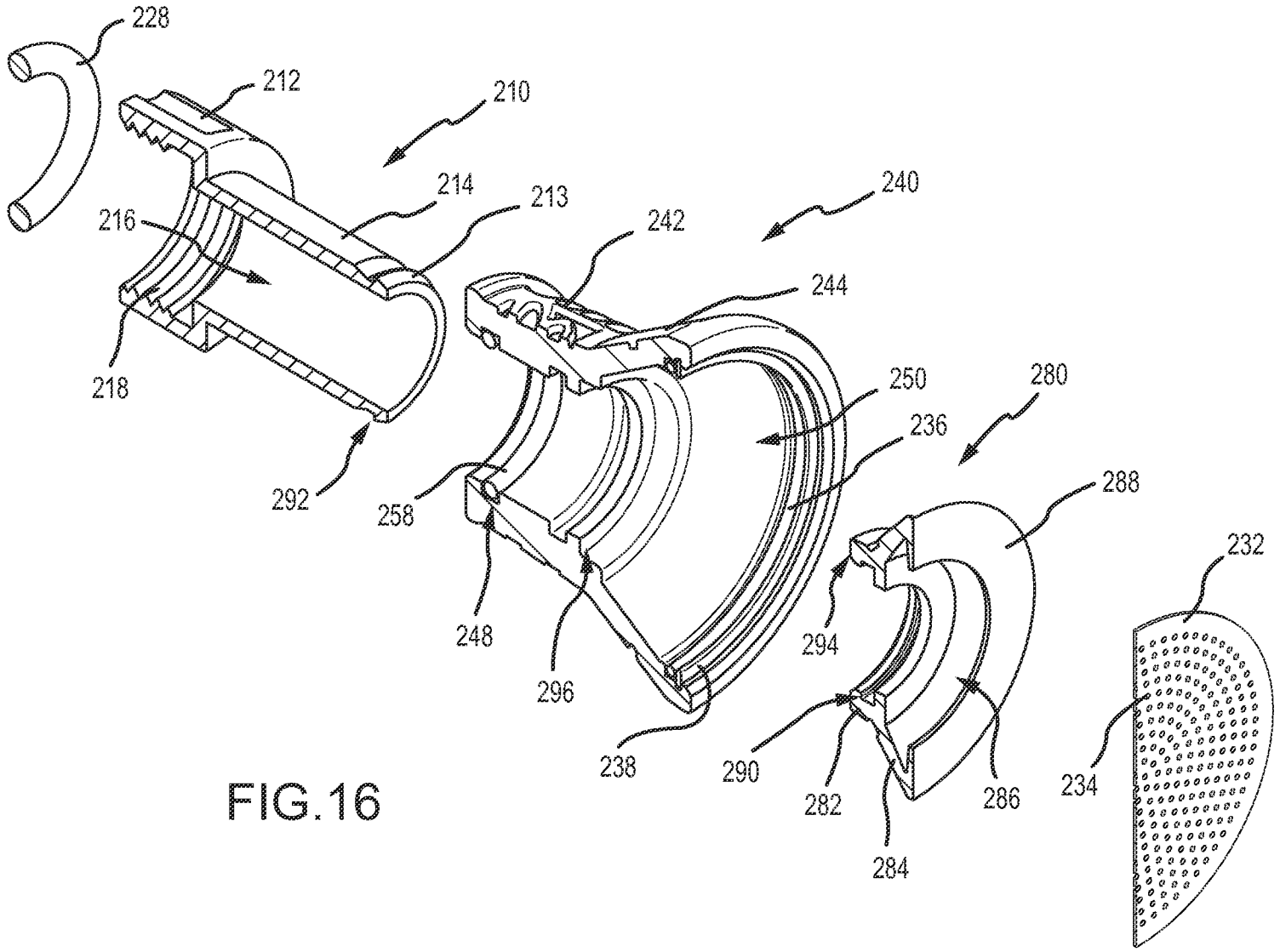
FIG. 16 is an exploded cross-sectional view of the adjustable sprayer shown in FIG. 15.
Figure 17:
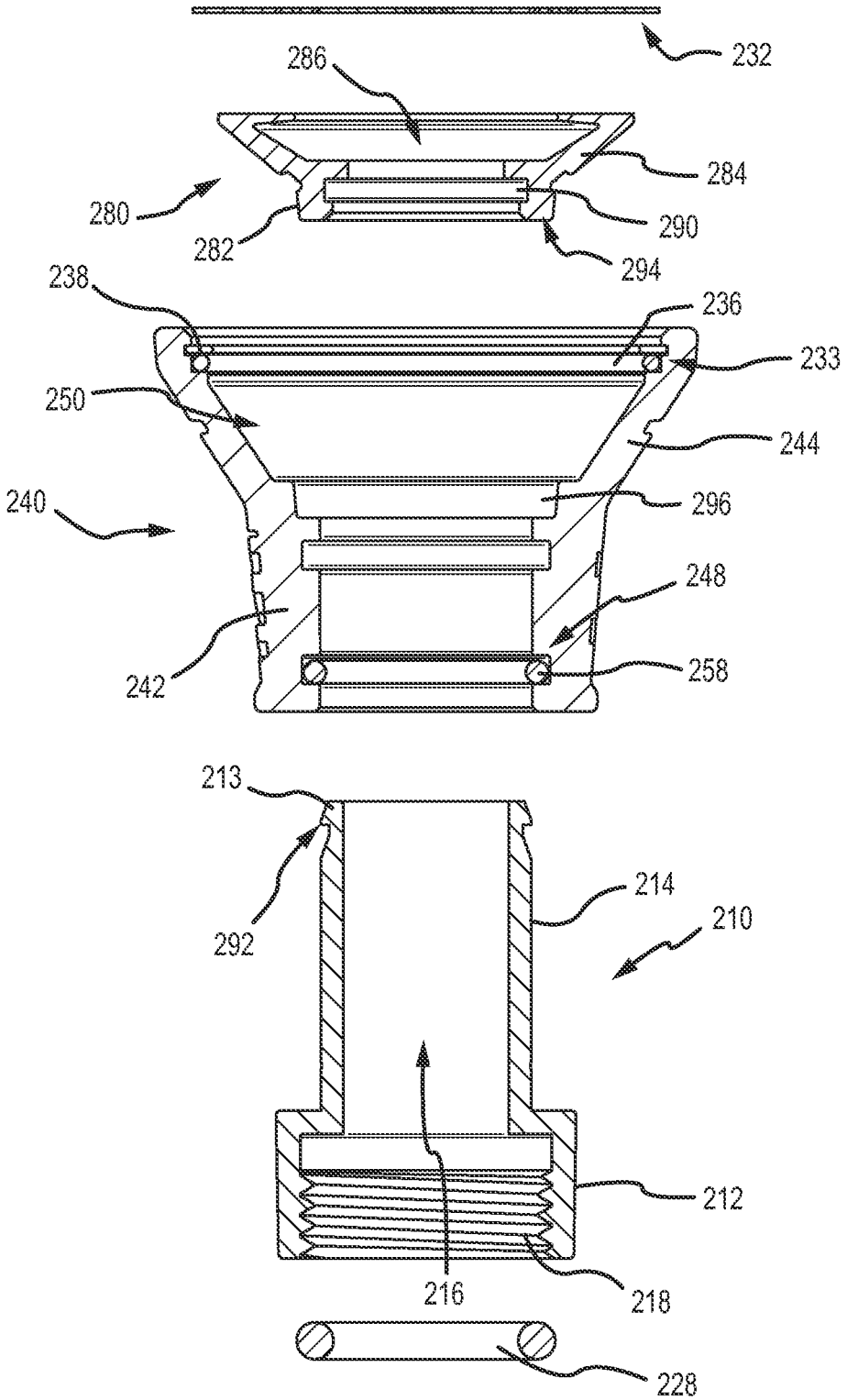
FIG. 17 is an exploded side view of the adjustable sprayer shown in FIG. 15.

With reference to FIGS. 15-17, nozzle 240 includes a sleeve portion 242 that is configured to receive the cylindrical portion 214. In this manner, the nozzle 240 is movable longitudinally along, and may rotate about, the cylindrical portion 214 between first and second spray positions. In various embodiments, sleeve portion 242 includes an O-ring groove or seal groove 248 within which an O-ring 258 is disposed. Accordingly, the elongate cylindrical portion 214 of fitting 210 is sealed against the O-ring 258 when inserted into the sleeve portion 142. Nozzle 240 also includes a surrounding sidewall 244, which extends from sleeve portion 242 to define an interior 250 of the nozzle 240. In various embodiments, surrounding sidewall 244 diverges away from the sleeve portion 242. The perforated screen 232 at least partially encloses the distal, open end of the nozzle 240. In some embodiments, the open end of the nozzle 240 includes an annular groove 233, which also accommodates an O-ring 236 against which the perforated screen 32 seals. A retaining ring 238 may be positioned within annular groove 239 to retain the perforated screen 232 within the nozzle 240 and in sealing engagement with the O-ring 236.

With reference to FIGS. 16-18B, the adjustable sprayer 205 includes an outlet insert 280. In various embodiments, the outlet insert 280 includes a cylindrical ring 282 and an output end portion 284, which extends outwardly from the cylindrical ring 282. In at least some embodiments, the output end portion 284 may have a generally frustoconical shape that terminates in an outlet 286. In some embodiments, a flange 288 is disposed to extend inwardly from an end of the output end portion 284 to define the shape of the outlet 286. In particular, the flange 288 includes an inner diameter edge portion that defines the outlet 286. In the depicted embodiment, the flange 288 extends generally perpendicular to a central axis of the cylindrical ring 282. The outlet insert 280 is coupled with the end portion 213. In some embodiments, the cylindrical ring includes an annular locking groove 290. In such embodiments, the locking groove 290 is positioned to receive an annular locking barb 292 that extends from the end portion 213, which is shaped to be press-fit within the locking groove 290. In this position, the outlet insert is disposed in the interior 250 of the nozzle 240.

Figure 18A:
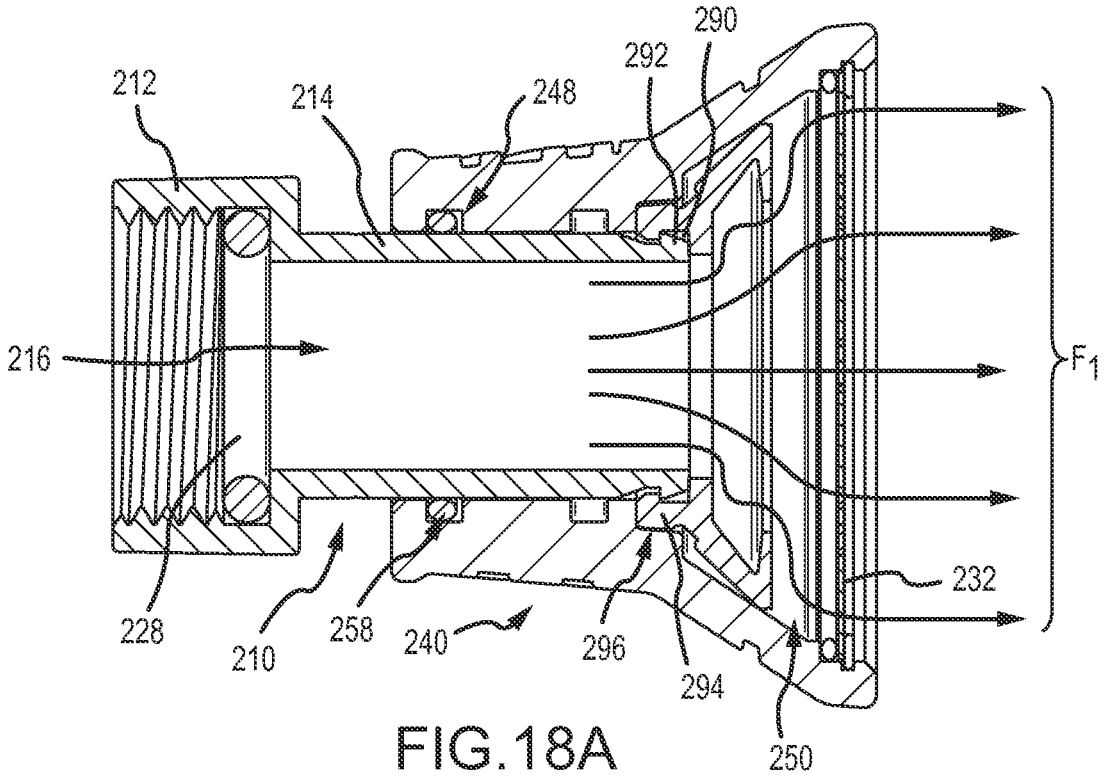
FIG. 18A is a cross-sectional side view of the adjustable sprayer shown in FIG. 15 in a first spray position.
Figure 18B:
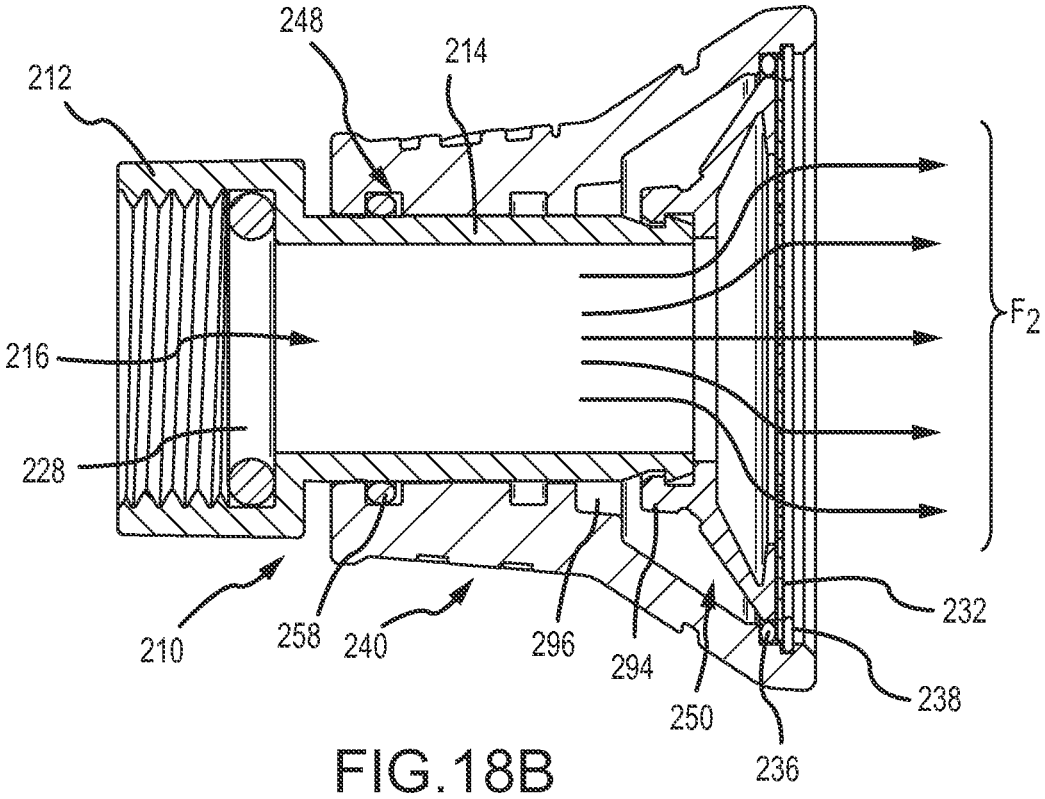
FIG. 18B is a cross-sectional side view of the adjustable sprayer shown in FIG. 15 in a second spray position.

With reference to FIGS. 18A and 18B, the first and second spray positions of the adjustable sprayer 205 may be more fully understood. In FIG. 18A, the adjustable sprayer 205 is shown in a first spray position in which the cylindrical portion 214 is fully retracted with respect to the nozzle 240. In this position, a shoulder 294 of the cylindrical ring 282 bottoms out within a recess 296 formed within a rearward end portion of the interior 250 of the nozzle 240. In this manner, the shoulder 294 and recess 296 serve as a positive stop to prevent withdrawal of the fitting 210 from the sleeve portion 242. A portion of an exterior surface of the output end portion 284 engages an interior surface of the surrounding sidewall 244 of the nozzle 240 when the nozzle is in the first position. Accordingly, when the nozzle 240 is in the first spray position, fluid flows from the outlet 286 of the outlet insert 280 and floods a forward portion of the interior 250 of the nozzle 240 before exiting through the perforated screen 232 as indicated by arrows F1. Specifically, fluid is allowed to flow through a first diameter or "full diameter" of the perforated screen 232, as defined by the surrounding sidewall 244, that retains the perforated screen 232 at its peripheral edge portion.

As shown in FIG. 18B, when the nozzle 240 is in the second spray position, the flange 288 of the outlet insert 280 is positioned against the perforated screen 232, creating a fluid pathway that extends from the outlet insert 280 and directly out the nozzle 240. In some embodiments, the outlet insert 280, or at least the flange 288, may be formed from a material with sealing properties, such as a resilient deformability. Accordingly, the flange 288 defines a second diameter or "reduced diameter" of the perforated screen 232 through which fluid is allowed to flow, as indicated by arrows F2. As depicted by FIGS. 18A and 18B, the "full diameter" of the perforated screen 232 is greater than the "reduced diameter" of the perforated screen 232. For example, in some embodiments, the "full diameter" may be approximately 1.81 inches and the "reduced diameter" may be approximately 1.12 inches. In particular embodiments, a diameter of the outlet 286 of the outlet insert 280 approximates the "reduced diameter." The restrictive nature of the "reduced diameter" will produce a more narrow fluid spray pattern that will reach a further distance than that afforded by the "full diameter" without altering the spray pattern.

The adjustable sprayers described herein may be comprised of various materials as one of ordinary skill in the art can appreciate. For example, the fitting 10, 110, 210 may be comprised of metal such as brass, aluminum, or steel. Alternatively, fitting 10, 110, 210 may be comprised of molded plastic such as ABS. Nozzle 40, 140, 240 may be comprised of brass, aluminum, or steel such as in the case of the fitting. Also, the nozzle 40, 140, 240 may be comprised of plastic such as ABS. The nozzle cover 141 may be comprised of a suitable material which may be either molded onto nozzle 140 or forcibly installed over the nozzle. Accordingly, nozzle cover 141 may be comprised of a hard rubber or other suitably flexible material. The components described herein may be molded or machined, for example.

Also contemplated herein are methods of varying the spray from a nozzle. The methods thus encompass the steps inherent in the above described structures and operation thereof. Although the technology and methods of using and/or applying the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An adjustable sprayer, comprising:

a fitting including a connector portion, an elongate cylindrical portion extending from the connector portion, an end portion opposite the connector portion, and a bore formed longitudinally through the fitting;

a nozzle including: (i) a sleeve portion configured to receive the cylindrical portion, whereby the nozzle is moveable along the cylindrical portion between first and second spray positions; (ii) a surrounding sidewall extending from the sleeve portion defining an open end of the nozzle; (iii) a water breaker positioned within the open end of the nozzle; and (iv) an interior region defined at least partially by the surrounding sidewall and water breaker;

an outlet insert having a cylindrical ring, supported by the end portion of the fitting in the interior region of the nozzle, and an open output end portion that extends outwardly from the cylindrical ring; and wherein the outlet insert is spaced rearwardly from the water breaker, within the interior region of the nozzle, when the nozzle is in the first spray position, whereby a fluid pathway extends from an outlet of the outlet insert to the interior region of the nozzle and then through a first diameter of the water breaker; and wherein the outlet insert contacts the water breaker when the nozzle is in the second spray position, whereby a fluid pathway extends from the outlet of the outlet insert directly through a second diameter of the water breaker, bypassing the interior region of the nozzle; the first diameter of the water breaker being larger than the second diameter of the water breaker.

2. The adjustable sprayer of claim 1, wherein:

a terminal end portion of the outlet insert is in sealing contact with the water breaker when the nozzle is in the second spray position.

3. The adjustable sprayer of claim 1, wherein:

the outlet insert further comprises a flange that extends radially inward from a terminal end portion of the output end portion; the flange having an inner diameter edge portion that defines the outlet of the outlet insert; and the flange contacting the water breaker when the nozzle is in the second spray position.

4. The adjustable sprayer of claim 3, wherein:

the flange of the outlet insert defines the second diameter of the water breaker.

5. The adjustable sprayer of claim 1, wherein:

a diameter of the outlet insert defines the second diameter of the water breaker.

6. The adjustable sprayer of claim 1, wherein:

the output end portion of the outlet insert is frustoconically shaped.

7. The adjustable sprayer of claim 1, wherein:

at least a portion of an exterior surface of the output end portion engages an interior surface of the surrounding sidewall of the nozzle when the nozzle is in the first position.

8. The adjustable sprayer of claim 7, wherein:

the surrounding sidewall of the nozzle diverges outwardly from the sleeve portion.

9. The adjustable sprayer of claim 1, wherein:

a rearward shoulder portion of the cylindrical ring engages a rearward portion of the nozzle interior region when the nozzle is in the first position.

10. The adjustable sprayer of claim 1, wherein:

a rearward shoulder portion of the cylindrical ring is received within an annular recess formed within a rearward portion of the nozzle interior region when the nozzle is in the first position.

11. The adjustable sprayer of claim 1, wherein:

the connector portion includes threads mateable with a garden hose.

12. The adjustable sprayer of claim 1, wherein:

the nozzle is rotatably disposed on the cylindrical portion of the fitting.

13. The adjustable sprayer of claim 1, wherein:

the water breaker is a perforated screen, having a plurality of uniformly sized and spaced-apart openings across a face of the water breaker.

14. An adjustable sprayer, comprising:

a fitting including a connector portion, an elongate cylindrical portion extending from the connector portion, an end portion opposite the connector portion, and a bore formed longitudinally through the fitting;

a nozzle including a sleeve portion configured to receive the cylindrical portion whereby the nozzle is moveable along the cylindrical portion between first and second spray positions, the nozzle further including a surrounding sidewall extending from the sleeve portion defining an interior region and an output opening;

an outlet insert having a cylindrical ring, supported by the end portion of the fitting in the interior region of the nozzle, and an open output end portion that extends outwardly and divergently from the cylindrical ring;

wherein the outlet insert is reciprocally movable within the interior region of the nozzle as the nozzle is moved, with respect to the fitting and the outlet insert, between the first and second spray positions;

the outlet insert being positioned adjacent a rearward end portion of the nozzle when the nozzle is in the first spray position, creating a fluid pathway that extends from the outlet insert, into the interior region of the nozzle, and out the nozzle output opening as a fluid stream having a first width;

the outlet insert being positioned adjacent the nozzle output opening when the nozzle is in the second spray position, creating a fluid pathway that extends from the outlet insert and out the nozzle output opening as a fluid stream having a second width, which is less than the first width; and a water breaker positioned within the output opening of the nozzle, wherein the outlet insert is positioned closely adjacent the water breaker when the nozzle is in the second spray position.

15. The adjustable sprayer of claim 14, wherein:

the outlet insert further comprises a flange that extends radially inward from a terminal end portion of the output end portion; the flange having an inner diameter edge portion that defines an outlet of the outlet insert; and the flange contacting the water breaker when the nozzle is in the second spray position.

16. The adjustable sprayer of claim 15, wherein:

the flange of the outlet insert defines the second width of the fluid stream.

17. The adjustable sprayer of claim 15, wherein:

the flange of the outlet insert is in sealing contact with the water breaker when the nozzle is in the second spray position.

* * * * *